US011486670B1

(12) United States Patent
Lovas

(10) Patent No.: US 11,486,670 B1
(45) Date of Patent: Nov. 1, 2022

(54) QUICK DISCONNECT SYSTEM FOR MUZZLE DEVICES

(71) Applicant: Seraph Enterprises, Inc., Bozeman, MT (US)

(72) Inventor: Stephen R. Lovas, Bozeman, MT (US)

( * ) Notice: Subject to any disclaimer, the term of this patent is extended or adjusted under 35 U.S.C. 154(b) by 17 days.

(21) Appl. No.: 17/224,449

(22) Filed: Apr. 7, 2021

Related U.S. Application Data

(60) Provisional application No. 63/014,217, filed on Apr. 23, 2020.

(51) Int. Cl.
*F41A 21/32* (2006.01)

(52) U.S. Cl.
CPC ..... *F41A 21/325* (2013.01)

(58) Field of Classification Search
CPC ..... F41A 21/30–42
USPC ..... 89/14.2–14.4; 181/223; 42/75.02
See application file for complete search history.

(56) References Cited

U.S. PATENT DOCUMENTS 2,466,400 A * 4/1949 Ennis ..... F41A 21/40 89/14.05
4,893,426 A * 1/1990 Bixler ..... F41A 21/325 89/14.05
5,433,133 A * 7/1995 La France ..... F41A 21/325 89/14.2
5,559,302 A * 9/1996 Latka ..... F41A 21/325 89/14.05
6,701,820 B2 3/2004 Fluhr
7,516,690 B2 * 4/2009 McClellan ..... F41A 21/34 89/14.3
7,661,349 B1 2/2010 Brittingham
8,424,441 B2 * 4/2013 Brittingham ..... F41A 21/30 89/14.4
8,499,676 B1 8/2013 Moore et al.
8,516,941 B1 8/2013 Oliver
8,555,765 B2 10/2013 Graham, II et al.
8,714,300 B2 * 5/2014 Johansen ..... F41A 21/30 89/14.4
8,826,793 B2 9/2014 Oliver
8,997,621 B1 * 4/2015 Dater ..... F41A 21/325 89/14.3
9,121,656 B1 * 9/2015 McKenzie ..... F41A 21/30
9,261,318 B2 2/2016 Wood, Jr. et al.
9,377,263 B1 * 6/2016 Sy ..... F41A 21/325
9,513,078 B1 * 12/2016 Fulton ..... F41A 21/325
9,631,888 B2 * 4/2017 Young ..... F41A 21/325
9,739,560 B1 * 8/2017 Salvador ..... F41A 21/32
(Continued)

*Primary Examiner* — Joshua E Freeman
*Assistant Examiner* — Benjamin S Gomberg
(74) *Attorney, Agent, or Firm* — Antoinette M. Tease

(57) ABSTRACT

A quick disconnect system for muzzle devices having a receiver and a clutch assembly. The receiver has a central bore, outer bearing surface, threaded region, tapered shoulder, collar and a plurality of receiver teeth. The receiver teeth are situated around an inner perimeter of a rear-most edge of a third section of the central bore of the receiver. The clutch assembly includes a locking lug mount, clutch ring, spring, and retainer ring. The locking lug mount has a central bore with a non-threaded portion and a threaded portion. A plurality of locking lugs are situated around an outside perimeter of a central portion of the locking lug mount, and each of the locking lugs is configured to fit between two adjacent receiver teeth. The spring is situated between the clutch ring and the retainer ring.

15 Claims, 9 Drawing Sheets

(56) References Cited

U.S. PATENT DOCUMENTS

| | | | | |
|---|---|---|---|---|
| 9,921,021 | B1 | 3/2018 | Graham, II | |
| 9,927,201 | B2 | 3/2018 | Penchuk | |
| 9,958,227 | B2 * | 5/2018 | Whitson | F41A 21/325 |
| 10,082,355 | B2 | 9/2018 | Addis | |
| 10,184,744 | B2 * | 1/2019 | Young | F41A 21/325 |
| 10,234,229 | B2 * | 3/2019 | Lessard | F41A 21/325 |
| 10,480,888 | B2 * | 11/2019 | Barrett | F41A 21/28 |
| 10,488,139 | B1 | 11/2019 | Graham, II et al. | |
| 10,508,878 | B1 * | 12/2019 | Oglesby | F41A 21/36 |
| 10,641,573 | B2 | 5/2020 | Jen et al. | |
| 10,670,362 | B2 * | 6/2020 | Wilson | F41A 21/36 |
| 10,830,550 | B2 * | 11/2020 | Wolf | F41A 21/325 |
| 10,852,091 | B1 * | 12/2020 | Helms | F41A 21/30 |
| 10,883,788 | B2 * | 1/2021 | Marcotte | F41A 21/482 |
| 10,921,080 | B2 * | 2/2021 | Hibbitts | F41A 21/44 |
| 11,054,208 | B2 * | 7/2021 | Johansen | F41A 21/325 |
| 11,143,477 | B1 * | 10/2021 | Oglesby | F41A 21/36 |
| 11,156,423 | B2 * | 10/2021 | Winterseth | F41A 21/34 |
| 11,243,040 | B2 * | 2/2022 | Honigmann | F41A 21/26 |
| 11,287,200 | B1 * | 3/2022 | Oglesby | F41A 21/325 |
| 11,287,207 | B2 * | 3/2022 | DeJessa | F41A 21/30 |
| 2003/0019351 | A1 | 1/2003 | Fluhr | |
| 2012/0180623 | A1 | 7/2012 | Graham, II et al. | |
| 2013/0263490 | A1 | 10/2013 | Oliver | |
| 2014/0237881 | A1 * | 8/2014 | Mack | F41A 21/325 42/90 |
| 2015/0135575 | A1 | 5/2015 | Wood, Jr. et al. | |
| 2016/0097609 | A1 | 4/2016 | Penchuk | |
| 2016/0102935 | A1 | 4/2016 | Young | |
| 2017/0241733 | A1 | 8/2017 | Salvador | |
| 2018/0017352 | A1 | 1/2018 | Addis | |
| 2018/0245872 | A1 | 8/2018 | Jen et al. | |
| 2019/0226787 | A1 | 7/2019 | Orne et al. | |
| 2019/0226788 | A1 | 7/2019 | Johansen et al. | |
| 2019/0316862 | A1 | 10/2019 | Orne et al. | |
| 2020/0025498 | A1 | 1/2020 | Wheeler | |
| 2020/0096280 | A1 | 3/2020 | Graham, II et al. | |
| 2020/0224989 | A1 * | 7/2020 | Bundy | F41A 21/325 |
| 2021/0199401 | A1 * | 7/2021 | Magee | F41A 21/30 |
| 2021/0389074 | A1 * | 12/2021 | Reis-Green | F41A 21/30 |

* cited by examiner

QUICK DISCONNECT SYSTEM FOR MUZZLE DEVICES

CROSS-REFERENCE TO RELATED APPLICATION

Pursuant to 35 U.S.C. § 119(e), this application claims the benefit of U.S. Provisional Application No. 63/014,217, filed on Apr. 23, 2020.

BACKGROUND OF THE INVENTION

1. Field of the Invention

The present invention relates generally to the field of firearms, and more particularly, to a quick disconnect system, comprised of a receiver and a clutch assembly, for securing an attachment (such as a suppressor, shroud, muzzle brake, etc.) to the muzzle end of a firearm barrel.

2. Description of the Related Art

U.S. Pat. No. 6,701,820 (Fluhr, 2004) discloses methods and an apparatus for fastening a silencer onto a firearm. The invention comprises a mounting device with a housing adapted to be mounted to the barrel so that the housing is fixed against rotation relative to the barrel. The invention further comprises a silencer holder that is rotatably mounted to the housing and a fastener for securing the silencer holder to the housing at an angular position, the fastener being a screw that engages the silencer holder and a circular groove defined around an outer surface of the housing.

U.S. Pat. No. 7,661,349 (Brittingham, 2010) provides an apparatus and method for attaching and removing a noise suppressor or other auxiliary device to the muzzle end of a firearm barrel. The apparatus comprises an attachment fixture with an aperture that is axially aligned with the bore and that has an annular abutment configured to provide a substantially forwardly facing abutment surface, as well as an annual series of circumferentially-spaced teeth and an external thread. The invention further comprises a noise suppressor with an internal thread and a lever member positioned proximate to the rearward end of the noise suppressor, the lever member having a ratchet pawl and being manually movable between first and second positions. The lever member is spring-biased for radial movement of the pawl into engagement with the series of teeth on the attachment fixture.

U.S. Pat. No. 8,499,676 (Moore el al., 2013) discloses a coupling system for attaching a device such as a blank adaptor or a sound suppressor to the flash hider of a firearm. The attachable device has external threads with plural cutouts formed therethrough, the cutouts being alignable with plural flat portions of the exterior surface of the flash hider. The plural cutouts have camming latches, each of which has a flat side that is engageable with a flat portion of the exterior surface of the flash hider. The invention further comprises a collar with interior threads, the collar being threadable to the attachment device. In the locked position, the collar engages the camming latches to prevent their movement.

U.S. Pat. No. 8,516,941 (Oliver, 2013) and U.S. Pat. No. 8,826,793 (Oliver, 2014) provide an interchangeable modular firearm mountable device that includes an inlet end coupling feature to removably couple with a muzzle end of a firearm and an outlet end coupling feature to removably couple with a secondary firearm muzzle mountable device beyond the muzzle end of the firearm. The device comprises a central chamber oriented along a central axis within an outer shell and a common off-axis chamber among a plurality of inlets of openings to the off axis chamber and having an off axis fluid outlet at the outlet end. The outlet end coupling feature removably couples with the secondary firearm muzzle mountable device such that the common off axis chamber outlet is aligned with an off axis chamber inlet of the secondary firearm muzzle mountable device.

U.S. Pat. No. 8,555,765 (Graham, II et al., 2013) discloses systems, methods and devices for attaching or removing a sound suppressor or other auxiliary device to a firearm. The device comprises a mount body that is threadably attachable to a muzzle attachment device attached to the muzzle of a gun. A locking spring extends around a portion of the mount body and has serrated pawls for engaging a portion of the muzzle attachment device. An annular, rotatable locking collar attaches to the mount body and extends over the locking spring. As the locking collar is rotated, the diameter of the inner surface of the locking collar is reduced, thereby urging the pawl into secured contact with the muzzle attachment device.

U.S. Pat. No. 9,261,318 (Wood, Jr. et al., 2016) provides a firearm accessory mounting assembly comprised of a coupler with opposed, inwardly curved side plates that form a cylindrical bore, the side plates having integrally joined upper ends and lower ends that are moveable toward each other to clamp the coupler to the barrel. The coupler has a retractable pin that is movable between an extended position and a retracted position. The invention further comprises an adapter with a rear end having a threaded bore for receiving the threaded end of the firearm barrel and a front end with a threaded projection for attachment to a firearm accessory. The adapter has a groove for receiving the pin when it is in an extended position.

U.S. Pat. No. 9,513,078 (Fulton et al., 2016) discloses a firearm barrel accessory (such as a firearm suppressor with a silencer barrel) that connects and disconnects to a firearm barrel through rotation of the accessory. A mount retention ring located inside of the silencer barrel has longitudinal grooves that lead to circumferential grooves with first and second radial sides. The firearm barrel is attached to a muzzle break that has a plurality of lugs that fit into the longitudinal grooves in the mount retention ring. When the silencer barrel and mount retention ring are rotated or twisted about the longitudinal axis of the silencer barrel, the circumferential grooves move relative to the lugs of the muzzle break until the lugs contact the second radial side of the circumferential grooves, at which point the mount retention ring ceases to rotate while the silencer barrel continues to rotate. An optional ratchet retention ring is configured to exert tension on the ount retention ring in the rearward direction.

U.S. Pat. No. 9,631,888 (Young, 2017) provides a quick connect device for a pistol suppressor, the device comprising a housing with a central bore and a piston within the central bore of the housing. The piston has a piston shoulder that creates an upper recess within a central bore of the piston. A ring connected to the second end of the piston is positioned between the housing and the piston, and a spring is positioned around the exterior of the piston. A compression (coiled) spring is situated around an exterior of the piston, and a wave spring is positioned in the upper recess of the piston adjacent to the piston shoulder. A washer is also positioned within the upper recess of the piston. A cap is connected to the piston, and the wave spring exerts pressure on the washer to biases it toward a locked position.

U.S. Pat. No. 9,739,560 (Salvador, 2017) discloses a system for attaching an accessory to a firearm, the system comprising a muzzle device with a coarse-threaded engagement means, either an annular grooved surface or a grooved surface engagement mechanism, and an adapter device. The adapter device includes an adapter having a forward portion including an accessory engagement means for receiving the accessory and a rearward portion having a second coarse-threaded engagement means formed on an inner surface of the adapter, a biasing mechanism received on the rearward portion, and a retainer ring received on the rearward portion adjacent to the biasing mechanism, the retainer ring having the other of the annular grooved surface and the grooved surface engagement mechanism. The male coarse-threaded engagement means and the female coarse-threaded engagement means cooperate to releasably secure the adapter device to the muzzle device.

U.S. Pat. No. 9,921,021 (Graham, II, 2018) provides a device for attaching or detaching a sound suppressor or other auxiliary device to a firearm. The invention comprises a mount body that is threadably attached to a muzzle attachment device. The muzzle attachment device has external mounting threads, a gas seal, an engagement surface, and a locking surface on the rear of the muzzle attachment device. A rotating collar is threadably attached to the mount body, and a locking spring fits inside of the rotating collar and is attached to the mount body. When rotated, the rotating collar forces the locking spring and its locking surfaces downward against the rear locking surface of the muzzle attachment device, thereby securing the sound suppressor or other auxiliary device to the muzzle attachment device.

U.S. Pat. No. 9,927,201 (Penchuk, 2018) discloses a barrel coupling for a firearm. The invention comprises a barrel adapter and a clamping mechanism. The barrel adapter has an inner threaded region and a wall with a bullet orifice with an annular shoulder between the inner threaded region of the barrel adapter and the wall with the bullet orifice. The clamping mechanism has a separator and a clamping sleeve, and the separator has two L-shaped cams that are removably mounted in cam sockets within the separator. The clamping mechanism has a cylindrical casing with an internal surface that is of frustoconical shape, and the cylindrical casing has an outer threaded region.

U.S. Pat. No. 10,082,355 (Addis, 2018) provides a muzzle adapter for a firearm, the muzzle adapter having an adapter element that defines an adapter bore, a portion of which is internally threaded to removably mate with the threaded muzzle. The adapter element has a tapered exterior surface portion and an externally threaded portion. The muzzle device has a tapered internal bore portion that is adapted to be closely received on the tapered exterior surface portion of the adapter element. The invention further comprises a collar element that is internally threaded to mate with the externally threaded portion of the adapter element. The collar element is also axially engaged to and rotatable independently of the muzzle device. Rotation of the collar draws the muzzle device onto the adapter element and wedges the tapered portion of the adapter element into the tapered internal bore portion of the muzzle device.

U.S. Pat. No. 10,488,139 (Graham. II et al., 2019) and U.S. Patent Application Pub. No. 20200096280 (Graham, II) disclose methods and interface devices for attaching a suppressor to a firearm muzzle. The interface device comprises an elongated body portion, a first end of which is configured to engage threadingly to a threaded portion of the firearm muzzle. The exterior surface of the body portion includes visible indica defining a preselected position such that when the suppressor is threadingly engaged with the elongated body and rotated to the preselected position, the suppressor is properly tightened with respect to the interface device.

U.S. Pat. No. 10,641,573 (Jen et al., 2020) provides a firearm blast reduction device that is installable on a muzzle of a firearm. The device includes a lock device, a muzzle device and a muzzle shroud. The muzzle shroud faces the front of the firearm, and the muzzle device faces the rear of the firearm. The lock device is received in the muzzle device and situated between the muzzle device and the muzzle shroud. The muzzle shroud is configured so that when rotated in a first direction, the muzzle shroud locks the firearm blast reduction device on the muzzle. When rotated in a second direction, the muzzle shroud releases the firearm blast reduction device from the muzzle. The lock device comprises a guide pin that is slidingly received in at least one guide slot in the muzzle device.

U.S. Patent Application Pub. No. 20140237881 (Mack) discloses a firearm suppressor mounting device with a device body, a clamping element connected to the device body, and a muzzle element that is configured to attached to the muzzle. The device body rotates between an attached and a detached position via the movable engagement element of the clamping element. When in a locked position, the engagement element is biased against the engagement surface of the muzzle element to prevent movement of the device to the detached position.

U.S. Patent Application Pub. Nos. 20190226787 and 20190316862 (Orne et al.) provide a firearm suppressor assembly with a quick release mount and lock. The system comprises an outer housing that radially encloses a plurality of baffles, a distal end cap that is associated with one end of the outer housing, and a mount collar that is associated with the opposite end of the outer housing. The mount collar defines a mounting and locking arrangement, which includes a plurality of lobes that cooperate with corresponding cavities defined by the mount collar in which the discrete lobes are less than 90 radial degrees from any other lobe.

U.S. Patent Application Pub. No. 20190226788 (Johansen el al., 2019) discloses a coupling member for attachment and detachment of a firearm accessory to a muzzle of a firearm. The coupling member comprises female and male members. The female member has a throughgoing bore and a number of successive threaded and unthreaded portions around the circumference of the bore. The male member has the same number of successive threaded and unthreaded portions as the female member. Each of the threaded and unthreaded portions of both the female and male members are equally displaced relative to each other.

U.S. Patent Application Pub. No. 20200025498 (Wheeler) provides a muzzle device assembly for a firearm. The invention comprises an alignment element that is configured to connect to the barrel, the alignment element having a lock element that is movable between a release position and an engaged position. The muzzle device has internal threads that mate with a threaded portion of the barrel, and the muzzle device defines a lock channel that is adapted to receive the lock element. The lock channel has wall portions that are configured to contact the lock element in the engaged position to prevent rotation of the muzzle device.

BRIEF SUMMARY OF THE INVENTION

The present invention is a quick disconnect system for muzzle devices comprising: a receiver; and a clutch assembly; wherein the receiver comprises a central bore, an outer bearing surface that forms a forward-most end of the receiver and is configured to receive an inner bearing surface of a locking lug mount, a threaded region that is configured to be threadably inserted into a muzzle device, a tapered shoulder that is situated between the outer bearing surface and the threaded region, a collar that forms a rearward-most end of the receiver, and a plurality of receiver teeth that are situated around an inner perimeter of a rear-most edge of a third section of the central bore of the receiver; wherein the clutch assembly comprises a locking lug mount, a clutch ring, a spring, and a retainer ring; wherein the locking lug mount comprises a central bore that is comprised of a non-threaded portion forming a front end of the locking lug mount and a threaded portion forming a rear portion of the locking lug mount; wherein a plurality of locking lugs are situated around an outside perimeter of a central portion of the locking lug mount; wherein each of the locking lugs is configured to fit between two adjacent receiver teeth; wherein a longitudinally oriented channel is situated between each adjacent pair of locking lugs: wherein the locking lug mount further comprises a threaded rear portion that is situated rearwardly of the plurality of locking lugs on an outside of the locking lug mount; and wherein the spring is situated between the clutch ring and the retainer ring.

In a preferred embodiment, the collar has an outer diameter, the threaded region has an outer diameter, the outer bearing surface has an outer diameter, the outer diameter of the collar is greater than the outer diameter of the threaded region, and the outer diameter of the threaded region is greater than the outer diameter of the outer bearing surface. In a preferred embodiment, the central bore of the receiver has varying inner diameters; wherein a first section of the central bore of the receiver has a constant inner diameter; wherein a second section of the central bore of the receiver is a tapered surface; wherein the third section of the central bore of the receiver has a constant inner diameter that is greater than the inner diameter of the first section; and wherein a fourth section of the central bore has an inner diameter that is greater than the inner diameter of the third section and is configured to fit over a front end of the clutch ring. Preferably, the plurality of receiver teeth equals in number the plurality of locking lugs.

In a preferred embodiment, the receiver teeth are equally spaced around the inner perimeter of the third section of the central bore of the receiver; and each receiver tooth is configured to fit within a channel between two adjacent locking lugs. In a preferred embodiment, inner-most surfaces of the plurality of receiver teeth collectively form an inner diameter that is equal to the inner diameter of the first section of the central bore of the receiver; and the inner diameter formed by the inner-most surface of the plurality of receiver teeth is greater than an outer diameter of an inner hearing surface of a locking lug mount. Preferably, each space between two adjacent receiver teeth forms a locking lug channel that is configured to receive a locking lug.

In a preferred embodiment, the clutch ring is circular in shape with a central aperture that has a same inner diameter as the first section of the central bore of the receiver. In a preferred embodiment, a perimeter of a front face of the clutch ring is configured to fit within an area defined by the collar of the receiver; and a rear side of the clutch ring comprises a first concentric recess that is configured to receive a front end of the spring. Preferably, the retainer ring has a central aperture that is configured to receive a threaded end of a firearm barrel.

In a preferred embodiment, the retainer ring comprises a flat back surface; a front end of the retainer ring comprises an outer concentric wall and an inner concentric wall; and a rear end of the spring is situated within a concentric cavity formed by the outer and inner concentric walls. In a preferred embodiment, an inside perimeter of the inner concentric wall is threaded: and a portion of the flat back surface of the retainer ring extends inwardly and concentrically beyond the inside perimeter of the inner concentric wall so that the threaded end of the firearm barrel is spaced apart from the inside perimeter of the inner concentric wall to form a second concentric recess. Preferably, each locking lug comprises two sides, at least one of which is sloped.

In a preferred embodiment, each locking lug comprises a top surface that is convex in shape to facilitate insertion of the locking lug into the locking lug channel. Preferably, the locking lug mount further comprises a well at a base of each locking lug and a shoulder on either side of the well to secure the receiver teeth in place when the system is in a locked position.

REFERENCE NUMBERS

1 Receiver
1*a* Central bore (of receiver)
1*b* Outer bearing surface
1*c* Tapered shoulder

1*d* Threaded region
1*e* Collar
1*f* Receiver teeth
1*g* Locking lug channel
1*h* Bottom edge (of receiver tooth)
1*i* Lip
2 Clutch assembly
2*a* Locking lug mount
2*b* Clutch ring
2*c* Spring
2*d* Retainer ring
2*e* Central bore (of locking lug mount)
2*f* Locking lug
2*g* Channel
2*h* First concentric recess
2*i* Central aperture
2*j* Flat hack surface (of retainer ring)
2*k* Outer concentric wall
2*l* Inner concentric wall
2*m* Second concentric recess
2*n* Threaded rear portion (of locking lug mount)
2*o* Well
2*p* Shoulder (of locking lug)
2*q* Inner bearing surface (of locking lug mount)
2*r* Front face (of clutch ring)
3 Muzzle device
4 Firearm barrel
4*a* Threaded end (of firearm barrel)

DETAILED DESCRIPTION OF INVENTION

Figure 1:
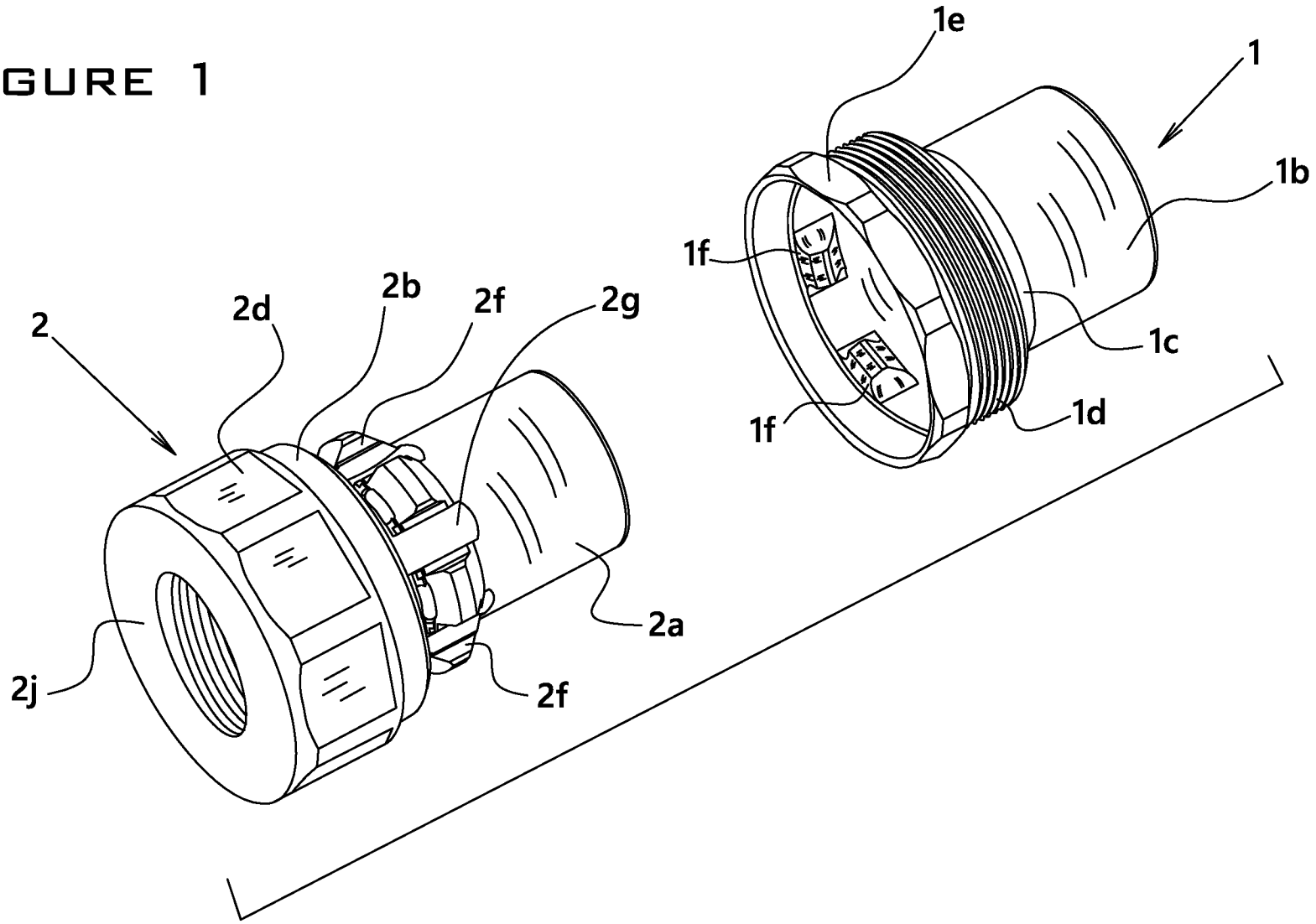
FIG. 1 is a first perspective view of the receiver and clutch assembly of the present invention.

FIG. 1 is a first perspective view of the receiver and clutch assembly of the present invention. As shown in this figure, the invention comprises a receiver 1 and a clutch assembly 2. As used herein, the terms "receiver" and "adapter" are used interchangeably. The receiver 1 is a single machined part with a central bore 1*a* and a series of outer geometries, the first of which is the outer bearing surface 1*b*. The outer bearing surface 1*b* forms the forward-most end of the receiver and is configured to receive the inner bearing surface of the locking lug mount (discussed below). Next, a tapered shoulder 1*c* is situated between the outer bearing surface 1*b* and a threaded region 1*d* of the receiver. The threaded region 1*d* is configured to be threadably inserted into a muzzle device. Moving along the receiver in a front to back direction, after the threaded region 1*d* is a collar 1*e*. The collar 1*e* forms the rearward-most end of the receiver and is preferably comprised of a plurality of flat surfaces around the outer circumference of the collar to facilitate rotation of the collar with a wrench. Note that the outer diameter of the collar 1*e* is greater than the outer diameter of the threaded region 1*d*, which is greater than the outer diameter of the outer bearing surface 1*b*.

Moving now to the inner region of the receiver 1, as noted above, the receiver comprises a central bore 1*a*, The central bore 1*a* has varying inner diameters. The first section of the central bore 1*a* has a constant inner diameter and corresponds to the outer bearing surface 1*b*; this section of the central bore 1*a* defines the smallest inner diameter of the central bore 1*a*. The next (second) section of the central bore 1*a* is a tapered surface on the inside of the receiver 1 that corresponds to the tapered shoulder 1*c*. The next (third) section of the central bore 1*a* has a constant inner diameter and corresponds to the threaded region 1*d*. The last (fourth, rearward-most) section of the receiver 1 is the collar 1*e*: this part of the receiver 1 has the greatest inner diameter (among all of the four parts of the receiver) and is configured to lit over the top (front end) of the clutch ring, which is discussed below.

Figure 14:
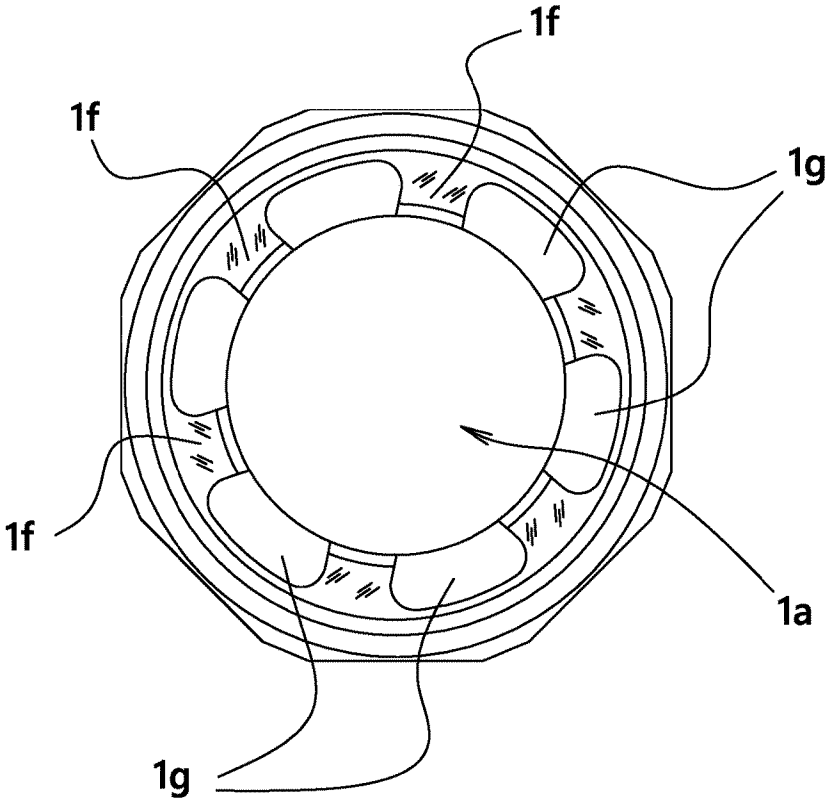
FIG. 14 is a rear view of the receiver of the present invention.

The receiver 1 also comprises a plurality of receiver teeth 1*f* situated around the inner perimeter of the rear-most edge of the third second of the central bore 1*a*. The number of receiver teeth 1*f* corresponds to the number of locking lugs (discussed below). The receiver teeth 1*f* are preferably equally spaced, and each receiver tooth 1*f* is configured to fit within one of the channels (discussed below) between the locking lugs. The inner-most surfaces of the plurality of receiver teeth 1*f* form an inner diameter that is equal to the inner diameter of the first section of the central bore 1*a* (see FIG. 14). This inner diameter (formed by the inner-most surfaces of the plurality of receiver teeth 1*f*) is slightly greater than the outer diameter of the inner hearing surface 2*q* of the locking lug mount (discussed below). Each of the spaces between two adjacent receiver teeth 1*f* forms a locking lug channel 1*g* that is configured to receive a locking lug 2*f* (see FIG. 14).

The clutch assembly 2 comprises four parts: a locking lug mount 2*a*, a clutch ring 2*b*, a spring 2*c*, and a retainer ring 2*d*. These parts are discussed more fully below in connection with FIG. 3.

Figure 2:
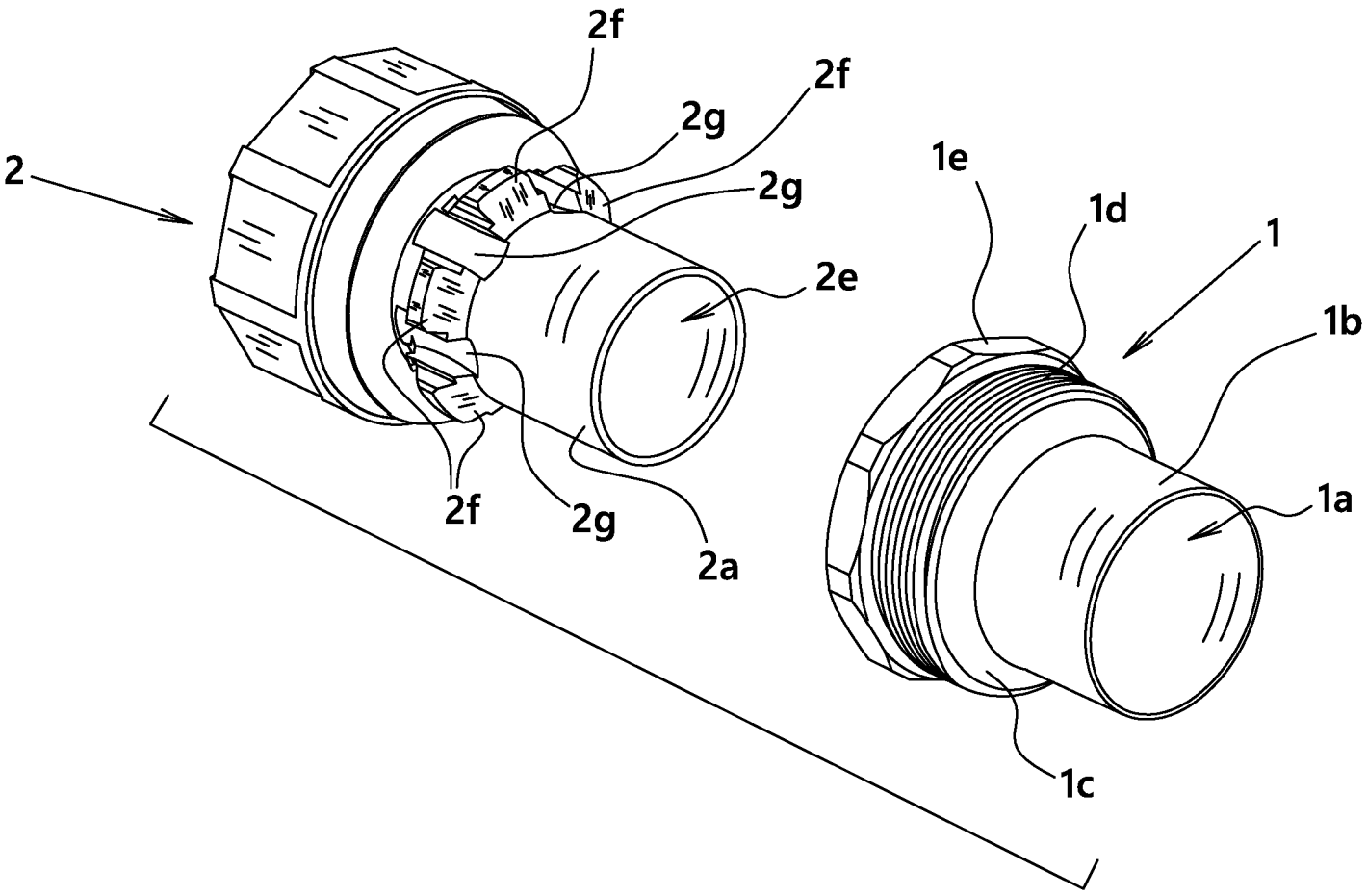
FIG. 2 is second perspective view of the receiver and clutch assembly of the present invention.
Figure 3:
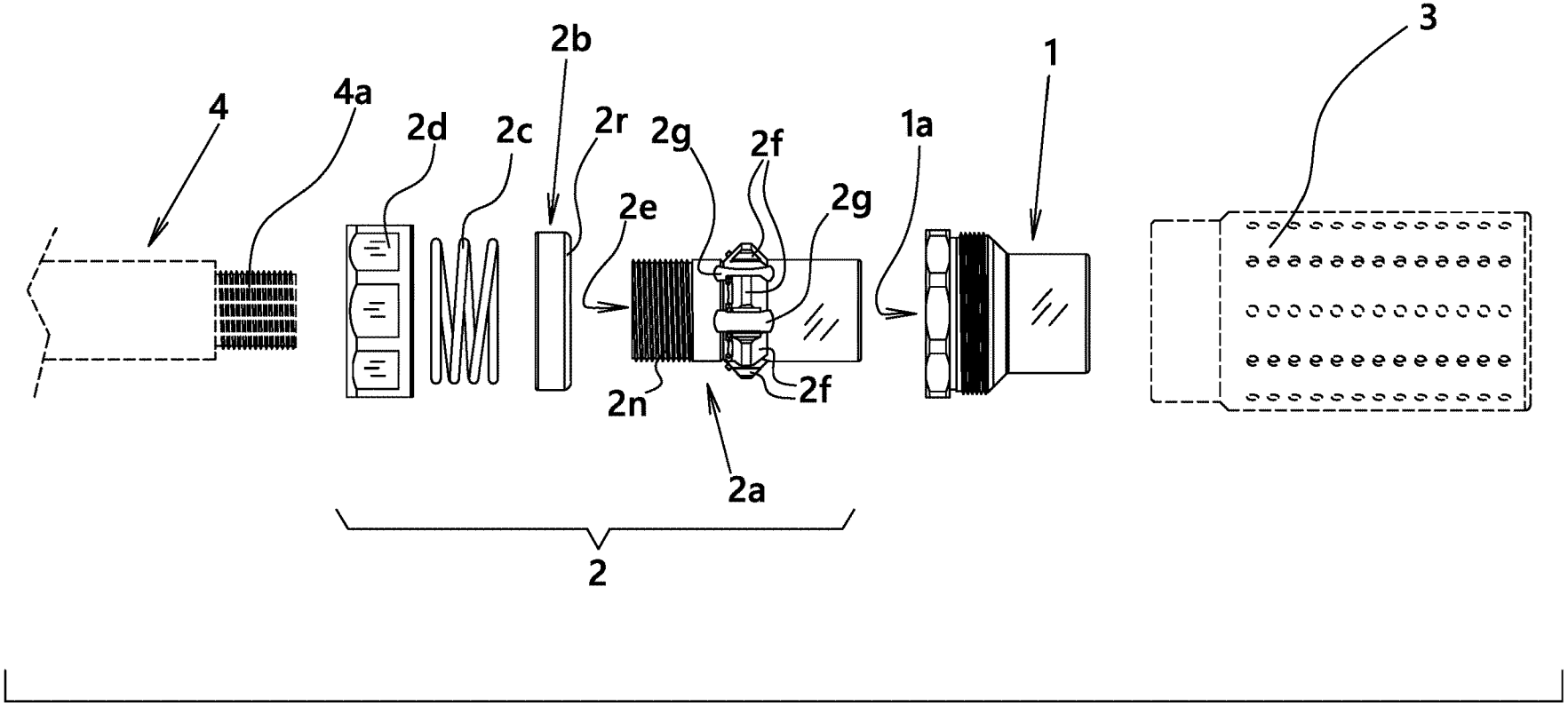
FIG. 3 is an exploded view of the present invention.

FIG. 2 is second perspective view of the receiver and clutch assembly of the present invention. In this figure, the clutch assembly 2 is fully assembled: FIG. 3 provides an exploded view of the clutch assembly.

FIG. 3 is an exploded view of the present invention. The receiver 1 has been fully described above. As noted above, the clutch assembly 2 is comprised of four parts. The locking lug mount 2*a* is a single machined piece with a central bore 2*e* defined therethrough. The central bore 2*e* of the locking lug mount 2*a* is comprised of a non-threaded portion (constituting the front portion of the locking lug mount) and a threaded portion (constituting the rear portion of the locking lug mount). A plurality of locking lugs 2*f*, corresponding in number and spacing to the receiver teeth 1*f*, is situated around the outside perimeter of a central portion of the locking lug mount 2*a*. Each of the locking lugs 2*f* is configured to fit in between two adjacent receiver teeth 1*f*. A longitudinally oriented channel 2*g* is situated between each adjacent pair of locking lugs 2*f*. The particular geometry of the locking lug 2*f* is discussed below in connection with FIG. 4. The locking lug mount 2*a* further comprises a threaded rear portion 2*n* (this portion of the locking lug mount 2*a* being situated rearwardly of the locking lugs 2*f*) on the outside of the locking lug mount 2*a*.

Figure 15:
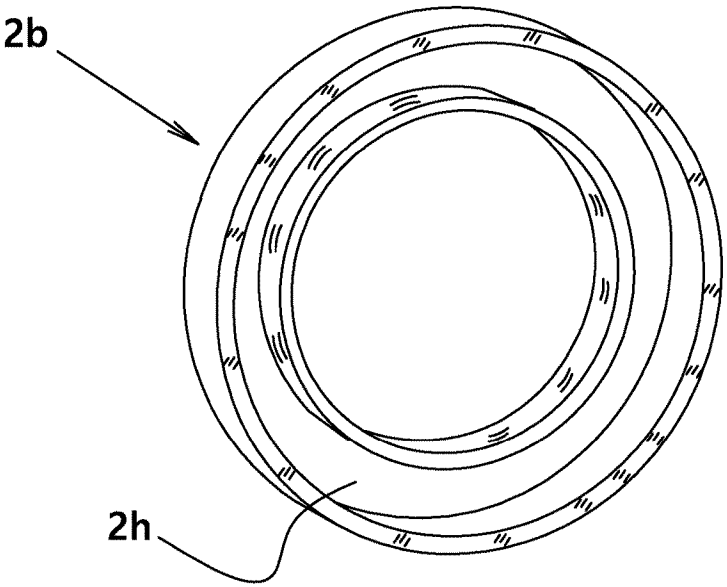
FIG. 15 is a rear perspective view of the clutch ring of the present invention.

The next part of the clutch assembly 2 is the clutch ring 2*b*. The clutch ring is circular in shape with a central aperture that has the same inner diameter as the first section of the central bore 1*a* of the receiver 1 (and of the inner diameter formed by the inner-most surfaces of the receiver teeth 1*f*). The perimeter of the front face 2*r* of the clutch ring 2*b* is preferably beveled, as shown, and configured to fit within the area defined by the collar 1*e* of the receiver 1, as explained above. The rear side of the clutch ring 2*b* comprises a first concentric recess 2*h* that is configured to receive the front end of the spring 2*c* (see FIG. 15).

The spring 3*c* is situated between the clinch ring 2*b* and the retainer ring 2*d*. The retainer ring 2*d* has a central aperture 2*i* that is configured to receive a threaded end 4*a* of a firearm barrel 4. The retainer ring 2*d* comprises a flat back (rear) surface 2*j*. The front end of the retainer ring 2*d* is open and comprises an outer concentric wall 2*k* and an inner concentric wall 2*l*. The rear end of the spring 2*c* is situated within the concentric cavity formed by outer and inner concentric walls. The inside perimeter (circumference) of the inner concentric wall 2*l* is threaded, and a portion of the flat back surface 2*j* of the retainer ring 2*d* extends inwardly and concentrically beyond the inside perimeter of the inner concentric wall 2*l* so that the threaded end of the firearm barrel 4*a* is spaced apart from the inside perimeter of the inner concentric wall 2*l* (see FIG. 12) to form a second concentric recess 2*m*. Accordingly, the threaded end 4*a* of the firearm barrel 4 does not screw into retainer ring 2*d* but rather is inserted through the central aperture 2*i* in the retainer ring.

To assemble the clutch assembly 2 on a firearm barrel 4, the retainer ring 2*d* is positioned over the threaded end 4*a* of the firearm barrel 4. The spring 2*c* is positioned in the second concentric recess 2*m* of the retainer ring 2*d*, and the clutch ring 2*b* is placed over the spring. The threaded end 4*a* of the firearm barrel 4 is screwed into the threaded (rear) portion of the central bore 2*e* of the locking lug mount 2*a*, while at the same time, the threaded rear portion 2*n* of the locking lug mount 2*a* is screwed into the threaded inside perimeter of the inner concentric wall 2*l* of the retainer ring 2*d*. With the clutch assembly 2 fully assembled, the spring 2*c* exerts forward (toward the muzzle device 3) tension on the clutch ring 2*b*.

Figure 4:
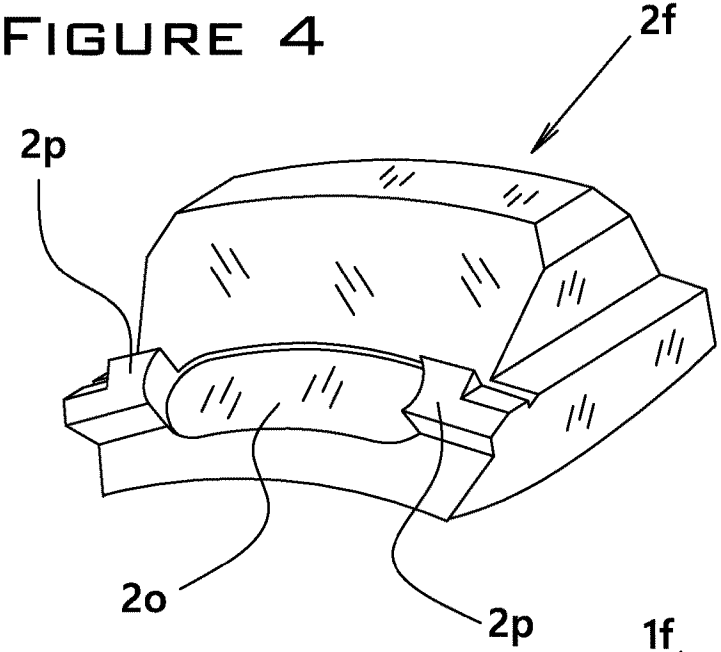
FIG. 4 is a detail view of one of the lugs on the locking lug mount of the present invention.
Figure 16:
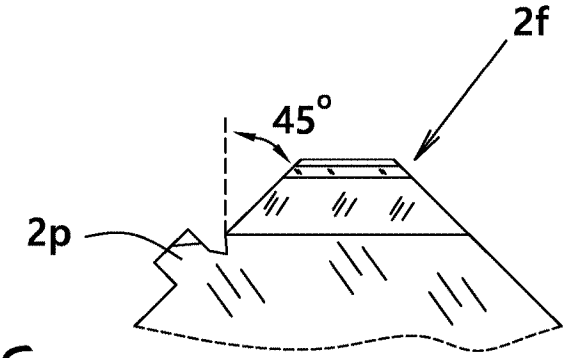
FIG. 16 is a side view of a locking lug of the present invention.

FIG. 4 is a detail view of one of the lugs on the locking lug mount of the present invention. As shown in this figure, each locking lug 2*f* comprises two sloped sides and a top surface (see also FIG. 16), the top surface preferably being slightly convex to facilitate insertion of the locking lug into the locking lug channel 1*g*. As shown in FIG. 16, the preferred angle of each of the sides of the locking lug 2*f* is forty-five degrees (45°): however, this angle may be in the range of forty-five (45) to eighty (80) degrees (as long as the angle of the receiver teeth is adjusted commensurately). Note that the receiver teeth 1*f* are also tapered at a 45-degree angle (see FIG. 6) so as to fit snugly against the locking lugs 2*f*. A well 2*o* at the base of each locking lug 2*f* with a shoulder 2*p* on either side of the well 2*o* secures the receiver teeth 1*f* in place when the device is in a locked position.

Figure 5:
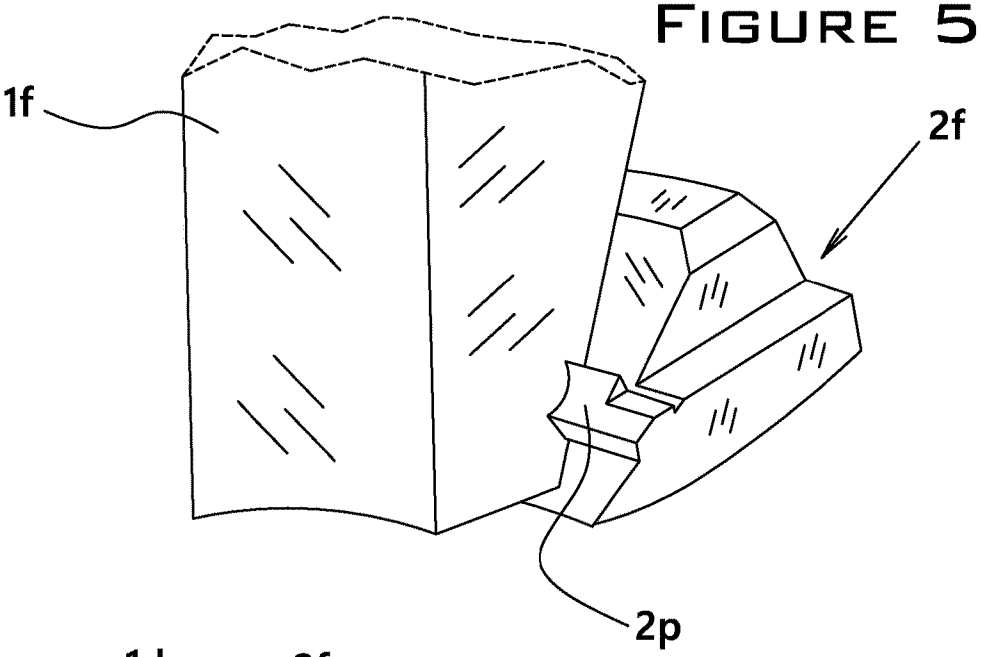
FIG. 5 is a detail view showing the coupling of one of the receiver teeth on the receiver of the present invention to one of the locking lugs on the locking lug mount of the present invention.
Figure 6:
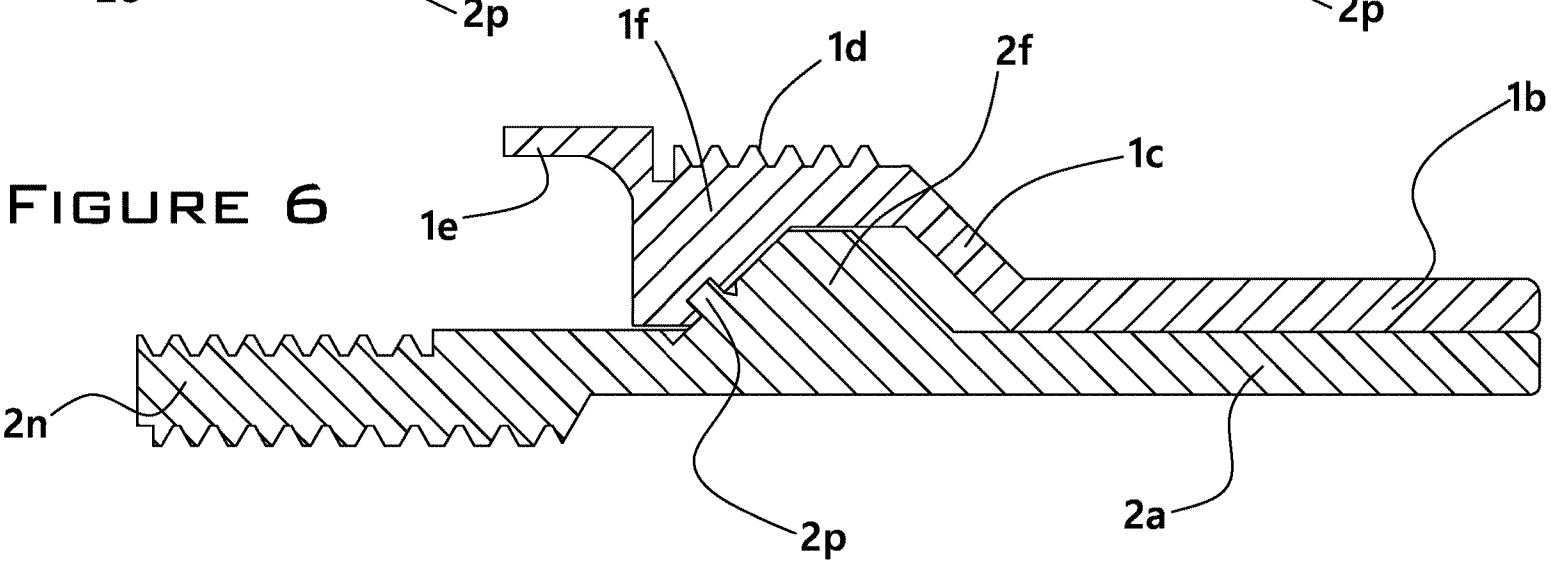
FIG. 6 is a section view of the coupled receiver tooth and locking lug shown in FIG. 5.

FIG. 5 is a detail view showing the coupling of one oldie receiver teeth on the receiver of the present invention to one of the locking lugs on the locking lug mount of the present invention. This figure shows the receiver tooth 1*f* in a locked position relative to the locking lug 2*f*, with the bottom portion of the receiver tooth situated within the well 2*o* and secured laterally by the shoulders 2*p*. FIG. 6 is a section view of the coupled receiver tooth and locking lug shown in FIG. 5.

Figure 7:
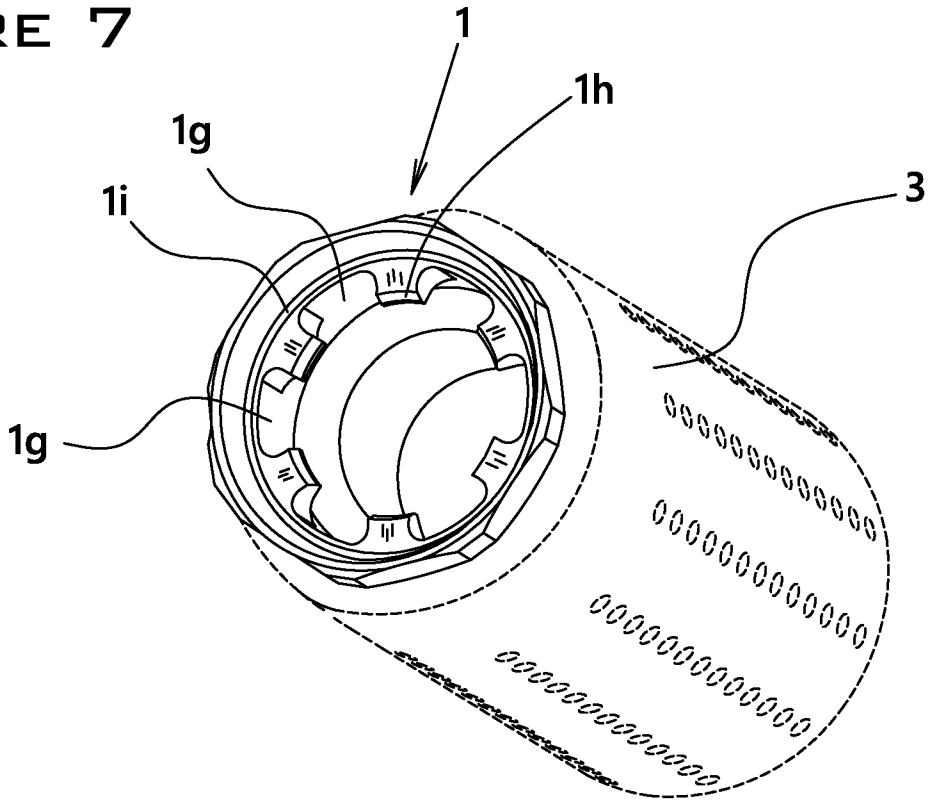
FIG. 7 is a perspective view of the receiver of the present invention shown attached to a suppressor.

FIG. 7 is a perspective view of the receiver of the present invention shown attached to a suppressor. As shown in this figure, the suppressor 3 (or other muzzle device) screws onto the threaded region 1*d* of the receiver 1. This figure clearly shows the locking lug channels 1*g* formed by two adjacent receiver teeth 1*f*.

Figure 8:
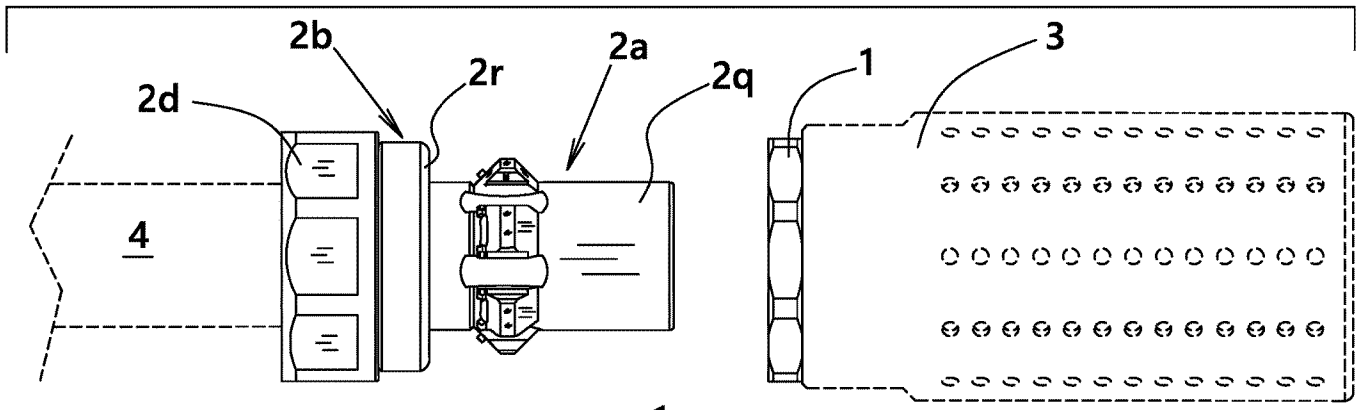
FIG. 8 is a side view of the present invention showing the receiver in relation to the clutch assembly prior to installation, with the receiver attached to a suppressor and the clutch assembly attached to a firearm barrel.

FIG. 8 is a side view of the present invention showing the receiver in relation to the clutch assembly prior to installation, with the receiver attached to a suppressor and the clutch assembly attached to a firearm barrel. In this figure, the inner bearing surface 2*q* of the locking lug mount 2*a* is aligned with the central bore 1*a* of the receiver.

Figure 9:
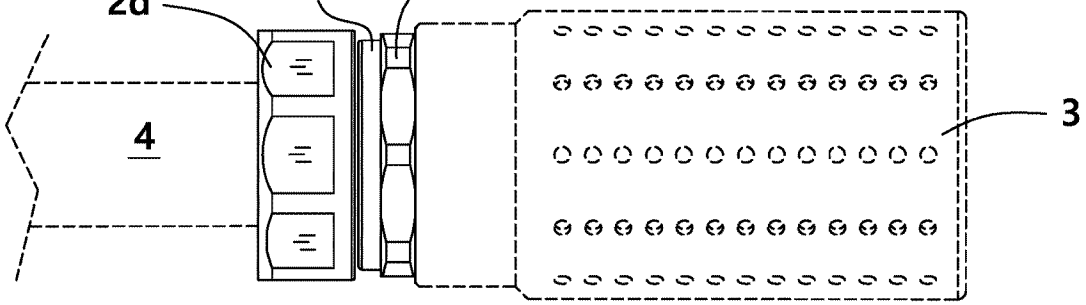
FIG. 9 is a side view of the present invention showing the receiver of the present invention coupled to the clutch assembly in an unlocked position prior to rotation of the receiver relative to the clutch assembly.

FIG. 9 is a side view of the present invention showing the receiver of the present invention coupled to the clutch assembly in an unlocked position prior to rotation of the receiver relative to the clutch assembly. In this figure, the locking lug mount 2*a* has been inserted into the receiver 1 so that the locking lugs 2*f* pass through the locking lug channels 1*g* until the bottom edges 1*h* of the receiver teeth 1*f* and a small lip 1*i* that extends around the perimeter of the inside of the receiver and is proximate to the bottom edges 1*h* of the receiver teeth abut up against the front face 2*r* of the clutch ring 2*b*.

Figure 10:
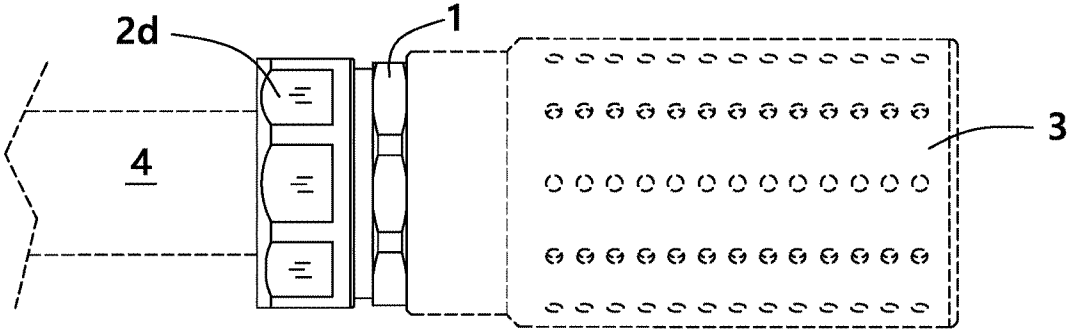
FIG. 10 is a side view of the present invention showing the receiver of the present invention coupled to the clutch assembly in a locked position after the receiver has been rotated relative to the clutch assembly.

FIG. 10 is a side view of the present invention showing the receiver of the present invention coupled to the clutch assembly in a locked position after the receiver has been rotated relative to the clutch assembly. To move the invention from an unlocked to a locked position, the user presses down on the spring 2*c*, pushing the receiver 1 toward the retainer ring 2*d* just enough to allow the receiver teeth 1*f* to clear the bottoms of the locking lugs 2*f*, and then the user rotates the receiver 1 in a clockwise direction (approximately thirty degrees) until the receiver teeth are situated within the wells 2*o* of the locking lugs 2*f*. The user then releases the pressure on the receiver 1, at which point the spring 2*c* biases the clutch ring 2*b* upward, thereby securing the receiver teeth 1*f* against the locking lugs 2*f*, as shown in FIG. 5. To unlock the invention, the user simply exerts downward pressure on the receiver and rotates it counterclockwise until the receiver teeth 1*f* are aligned with the channels 2*g*, at which point the receiver 1 can be slid off of the locking lug mount 2*a*.

Figure 11:
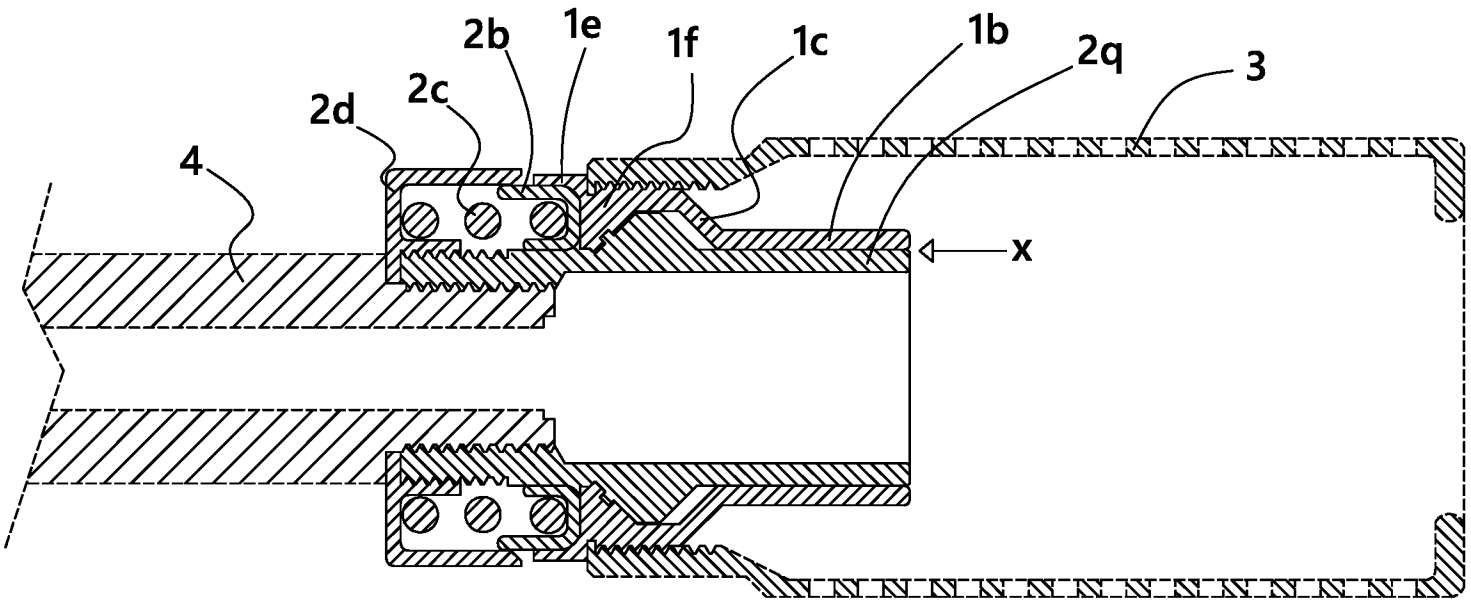
FIG. 11 is a cross-section view of the present invention with the receiver and clutch assembly in a locked position.

FIG. 11 is a cross-section view of the present invention with the receiver and clutch assembly in a locked position. As shown in this figure, when the invention is assembled and in a locked position, the cylindrical inner bearing surface 2*q* of the locking lug mount 2*a* slides into and abuts up against the cylindrical outer bearing surface 1*b* of the receiver 1. Note also that the inner and outer bearing surfaces 2*q*. 1*b* are configured so that the front end of each bearing surface 2*q*, 1*b* are radially aligned, as shown (see "X" on FIG. 11). It is important to note that with the present invention, the spring 2*c* is never situated inside of the suppressor 3 but rather is situated entirely outside of the suppressor, between the suppressor and the firearm barrel.

Figure 13:
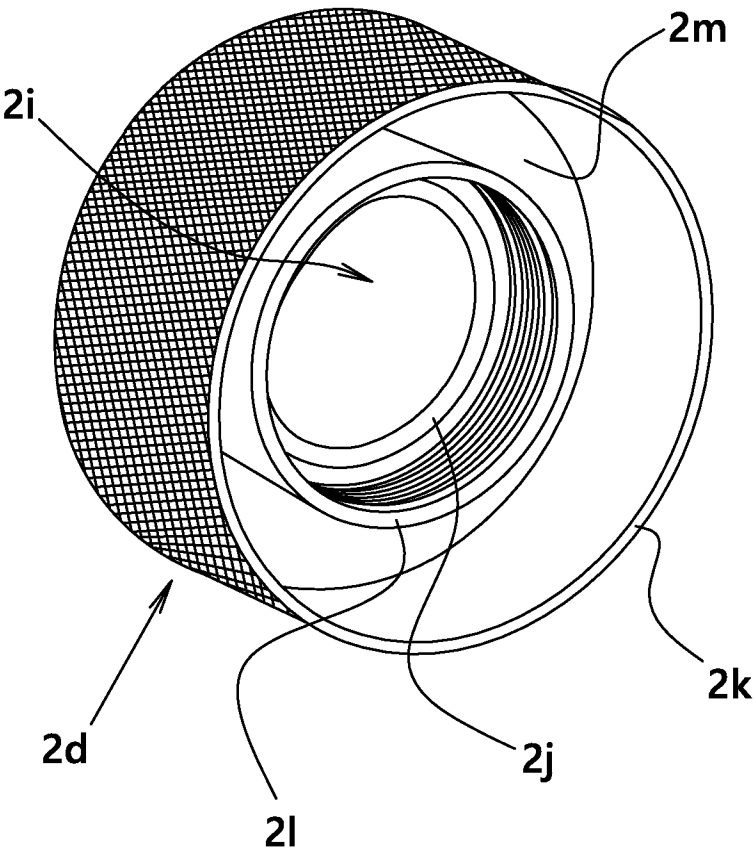
FIG. 13 is a perspective view of a second embodiment of the retainer ring of the present invention.
Figure 12:
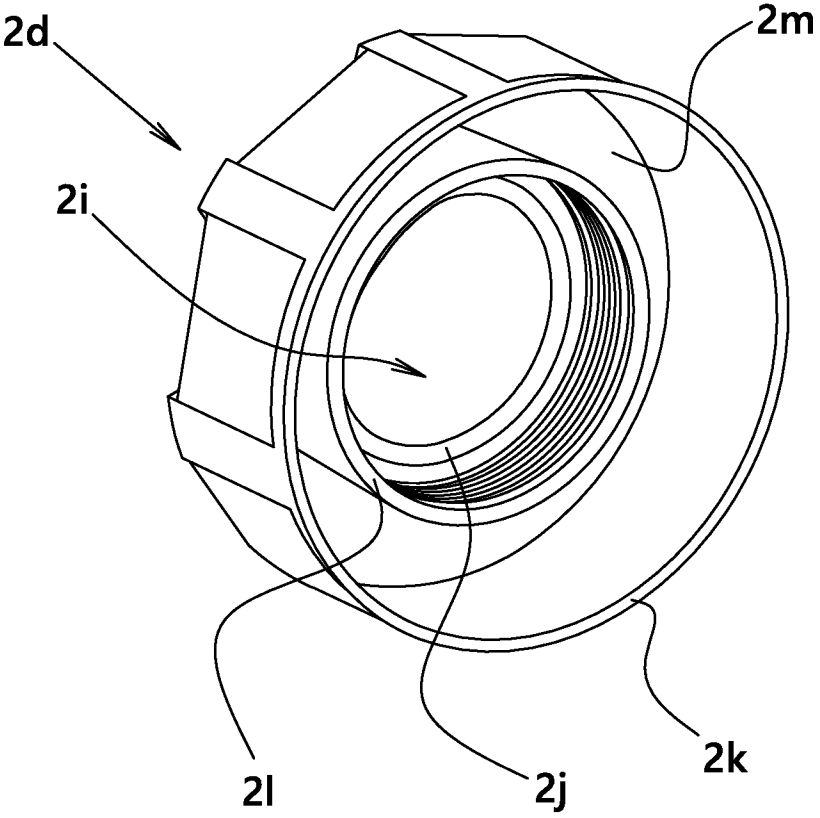
FIG. 12 is a perspective view of a first embodiment of the retainer ring of the present invention.

FIG. 12 is a perspective view of a first embodiment of the retainer ring of the present invention. This is the embodiment of the retainer ring 2*d* that is shown in the preceding figures. FIG. 13 is a perspective view of a second embodiment of the retainer ring of the present invention. In this embodiment, the flat surfaces on the outside perimeter of the retainer ring 2*d* have been replaced with knurling.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A quick disconnect system for muzzle devices comprising:

an adapter; and a clutch assembly;

wherein the adapter comprises:

a central bore;

an outer bearing surface that forms a forward-most end of the adapter and is configured to receive an inner bearing surface of a locking lug mount;

a threaded region that is configured to be threadably inserted into a muzzle device;

a tapered shoulder that is situated between the outer bearing surface and the threaded region;

a collar that forms a rearward-most end of the adapter; and a plurality of adapter teeth that are situated around an inner perimeter of a rear-most edge of a third section of the central bore of the adapter;

wherein the clutch assembly comprises:

the locking lug mount;

a clutch ring;

a spring; and a retainer ring;

wherein the locking lug mount comprises a central bore that is comprised of a non-threaded portion forming a front end of the locking lug mount and a threaded portion forming a rear portion of the locking lug mount;

wherein a plurality of locking lugs are situated around an outside perimeter of a central portion of the locking lug mount;

wherein each of the plurality of locking lugs is configured to fit between two adjacent adapter teeth of the plurality of adapter teeth;

wherein a longitudinally oriented channel is situated between each adjacent pair of the plurality of locking lugs;

wherein the locking lug mount further comprises a threaded rear portion that is situated rearwardly of the plurality of locking lugs on an outside of the locking lug mount; and wherein the spring is situated between the clutch ring and the retainer ring.

2. The quick disconnect system of claim 1, wherein the collar has an outer diameter, the threaded region has an outer diameter and the outer bearing surface has an outer diameter; and wherein the outer diameter of the collar is greater than the outer diameter of the threaded region, and the outer diameter of the threaded region is greater than the outer diameter of the outer bearing surface.

3. The quick disconnect system of claim 1, wherein a first section of the central bore of the adapter has a constant inner diameter;

wherein a second section of the central bore of the adapter is a tapered surface;

wherein the third section of the central bore of the adapter has a constant inner diameter that is greater than the inner diameter of the first section; and wherein a fourth section of the central bore has an inner diameter that is greater than the inner diameter of the third section and is configured to fit over a front end of the clutch ring.

4. The quick disconnect system of claim 3, wherein inner-most surfaces of the plurality of adapter teeth collectively have an inner diameter that is equal to the inner diameter of the first section of the central bore of the adapter; and wherein the inner diameter of the inner-most surfaces of the plurality of adapter teeth is greater than an outer diameter of the inner bearing surface of the locking lug mount.

5. The quick disconnect system of claim 3, wherein the clutch ring is circular in shape with a central aperture having an inner diameter; and wherein the inner diameter of the central aperture of the clutch ring is substantially equal to the inner diameter of the first section of the central bore of the adapter.

6. The quick disconnect system of claim 1, wherein the plurality of adapter teeth equals in number the plurality of locking lugs.

7. The quick disconnect system of claim 6, wherein the plurality of adapter teeth are equally spaced around the inner perimeter of the third section of the central bore of the adapter; and wherein each of the plurality of adapter teeth is configured to fit within the channel between two adjacent locking lugs of the plurality of locking lugs.

8. The quick disconnect system of claim 7, wherein each space between two adjacent adapter teeth of the plurality of adapter teeth forms a locking lug channel that is configured to receive a locking lug of the plurality of locking lugs.

9. The quick disconnect system of claim 8, wherein each of the plurality of locking lugs comprises a top surface that is convex to facilitate insertion of the locking lug into the locking lug channel.

10. The quick disconnect system of claim 1, wherein a perimeter of a front face of the clutch ring is configured to fit within an area defined by the collar of the adapter; and wherein a rear side of the clutch ring comprises a first concentric recess that is configured to receive a front end of the spring.

11. The quick disconnect system of claim 1, wherein the retainer ring has a central aperture that is configured to receive a threaded end of a firearm barrel.

12. The quick disconnect system of claim 11, wherein the retainer ring comprises a flat back surface; and wherein a front end of the retainer ring comprises an outer concentric wall and an inner concentric wall; and wherein a rear end of the spring is situated within a concentric cavity formed by the outer and inner concentric walls.

13. The quick disconnect system of claim 12, wherein an inside perimeter of the inner concentric wall is threaded; and wherein a portion of the flat back surface of the retainer ring extends inwardly and concentrically beyond the inside perimeter of the inner concentric wall so that the threaded end of the firearm barrel is spaced apart from the inside perimeter of the inner concentric wall to form a second concentric recess.

14. The quick disconnect system of claim 1, wherein each of the plurality of locking lugs comprises two sides, at least one of which is sloped.

15. The quick disconnect system of claim 1, wherein the locking lug mount further comprises a well at a base of each of the plurality of locking lugs and a shoulder on either side of the well to secure the plurality of adapter teeth in a locked position.

* * * * *